United States Patent [19]

Lu

[11] Patent Number: 5,039,915

[45] Date of Patent: Aug. 13, 1991

[54] MULTIPURPOSE FLUORESCENT LIGHT DEVICE

[76] Inventor: Hsing-Tseng Lu, 3rd Fl., No. 14, Lane 96, Chinhsing Rd. Chinmei District, Taipei, Taiwan

[21] Appl. No.: 419,845

[22] Filed: Oct. 10, 1989

[51] Int. Cl.[5] ..... H05B 37/00

[52] U.S. Cl. ..... 315/175; 315/291; 315/DIG. 5; 362/362

[58] Field of Search ..... 315/291, 175, DIG. 5, 315/283; 362/369, 362; 174/32, 35 C, ; 338/61, 62, 214, 267, 296

[56] References Cited

U.S. PATENT DOCUMENTS 3,577,174 5/1971 Longsderff ..... 315/175

4,092,706 5/1978 Vest ..... 362/369

4,161,674 7/1979 Maurer ..... 315/175

4,262,327 4/1981 Kovacik ..... 362/362

4,733,059 3/1988 Goss ..... 338/22

*Primary Examiner*—Eugene R. LaRoche

*Assistant Examiner*—Amir Zarabian

*Attorney, Agent, or Firm*—Ladas & Parry

[57] ABSTRACT

A multipurpose fluorescent light device suitable for use with power sources of 12 volts DC and 220 volts AC without having to use a voltage transformer, comprising a fluorescent lamp, a pair of antivibration covers, a starter switch, a circuit board assembly, a pair of positive and negative bypassing connections, a 120/220 voltage reduction wire, a 12 volt power cord, a transparent, heat-resistant plastic tube and a hook.

5 Claims, 3 Drawing Sheets

MULTIPURPOSE FLUORESCENT LIGHT DEVICE

BACKGROUND OF THE INVENTION

Some conventional fluorescent lights are for exclusive use on 12 volts DC but not on AC sources; some are used on 120 or 220 volts AC but suitable only for use with AC source of one single voltage and often a transformer is utilized such that the transformer is susceptible to damage when the voltage is too low or the lamp is likely to flash or may have a reduced service life due to inadequate power supply. In addition, the range of voltage which can be applied to the typical lamps using a transformer is relatively limited. For example, a 120 volt rating lamp can be used only on 85-140 volts AC and a 220 volt rating lamp only on 200-260 volts AC.

SUMMARY OF THE INVENTION

The present invention is intended to provide a fluorescent light device for use with different types of power sources which is suitable for operating on 12 volts DC, 120 and 220 volts AC. The fluorescent light device of the present invention is not only extremely simple in structure without requiring the use of a transformer such that the manufacturing cost is substantially reduced but also, by utilizing impedance conversion of a 220 volt voltage reduction wire, capable of operating within wider range of AC sources, such as in the range of 70-180 and 160-280 volts AC without flashing of the lamp. In addition, the fluorescent light of the present invention can give a higher output such that it is brighter than the conventional fluorescent lights which use a transformer and the configuration can be designed for securing on the ceiling in the conventional manner as well as for use with a hook so as to serve as a working light, such that it can be widely used in homes, automobiles, factories, and other working sites.

BRIEF DESCRIPTION OF THE DRAWINGS

FIG. 1 is a schematic view showing the assembly of a most preferable embodiment of the multipurpose fluorescent light of the present invention, the multipurpose fluorescent light device (20) of the present invention comprising: a common fluorescent lamp (1) which can be of 8, 15, or 20 watts rating, the sides being each connected to an antivibration cover (2), a set of connecting lines electrically connected to the sleeve terminals (3) of the pins on both sides of said lamp as shown in FIG. 2; a transparent heat-resistant plastic (PVC) tube (17) disposed coaxially around the fluorescent lamp (1), both sides thereof being fitted with a lower heat-resistant grip-shaped casing (14) and an upper heat-resistant grip-shaped casing (15) so as to secure the entire light assembly; a hook (16) being connected to the upper heat-resistant grip-shaped casing (15) for the light device to be suspended therefrom; an ON—ON starter switch (6) being disposed on the side of the lower grip-shaped casing (14) for starting on 220 volt power sources; a pair of positive and negative pole bypassing connections (8) bridged between the fluorescent lamp and DC/AC power sources. The present invention is extremely simple in structure and can be used with both DC and AC sources. It can be mounted on the ceiling in a conventional manner or by using a hook so as to serve as a mobile working light.

In FIG. 2, the sides of the fluorescent lamp (1) are connected to a pair of antivibration covers (2), each cover being in the shape of lamp holder having round holes in the center thereof, each of the left and right side of the lamp having a pair of lamp pins (8) which thread through the central round holes on the antivibration covers to be electrically connected to the pair of the sleeve terminals (3) on each of the sides, the wiring thereof being as shown in the drawing. Each of said sleeve terminals (3) is fitted with a transparent insulation cover (4), one end of the starter switch (6) being connected to one sleeve terminal and the other end being connected to a positive end of the electronic circuit board assembly (7). The electronic circuit board assembly (7) comprises a 12 volt electronic circuit (71) for preventing high voltage return current, and a current resisting coil (72) of about 30 Henries for voltage storage and for igniting the fluorescent lamp with said starter switch, used exclusively for 120 volt operation. In addition to connecting to the sleeve terminals via said set of connecting lines (5), the electronic circuit board assembly is connected to a pair of positive, and negative bypassing line connection seats (9), respectively, by means of a pair of positive and negative bypassing connections (8), said pair of positive and negative bypassing connections comprising a first positive and negative bypassing connection (81) electrically connected to the current resisting coil (72) and a second positive and negative bypassing connection (82) electrically connected to the 12 volt electronic circuit (71), and said pair of positive and negative bypassing line connection seats (9) comprising a first bypassing line connection seat (91) and a second bypassing line connection seat (92). The first bypassing line connection seat (91) is connected to a 220 volt voltage reduction wire (10), the other end of this voltage reduction wire (10) being connected to an AC power plug (11), said voltage reduction wire comprising mainly an alloy resistor wire (101, shown in greater detail in FIG. 3) of an impedance depending on the power source such that, by matching the voltage reduction by the resistor wire with the impedance, maximal power can be supplied to the fluorescent lamp for brighter light and that the lamp can be used within very wide voltage range, for operating on 70-180 and 160-280 volts respectively, without the disadvantages of flashing and reduced service life of the lamp due to the overlowered voltage from the power source. The second bypassing line connection seat (92) is connected to a 12 volt power cord (13), the other end of this power cord (13) being connected to a 12 volt car lighter plug. The present invention is suitable for use with power sources of 12 volt DC, 120/220 volt (70-180/160-280 volt) AC with a simplified configuration which is easy to operate and provides excellent illumination without flashing due to overlowered voltage.

FIG. 3 shows the detailed structure of the 120/220 volt voltage reduction wire of the present invention. Said voltage reduction wire comprises an alloy resistor wire (101) connected to the positive pole of the positive and negative bypassing line connection seat (91) and a copper wire (103) connected to the negative pole of the positive and negative bypassing line connection seat (91), the alloy resistor wire (101) being wound over a fiberglass wire (102) in such a manner that the pitches between adjacent alloy wires being equal, i.e., X1=X2=X3. The alloy resistor wire (101) is used for reducing voltage without producing heat and has matching impedance for the same lamp to used with different AC sources so as to supply maximal power to the fluorescent lamp such that not only the transformer can be eliminated but also the length thereof can be up to 5 meters (conventional single power source fluorescent light without a transformer has, at best, a cord length of 1.5 meters). According to a preferred embodiment of the present invention, when an 8 watt lamp is used, the impedance of the alloy resistor wire (101) can be adjusted depending on the power source as follows:

Figure 1:
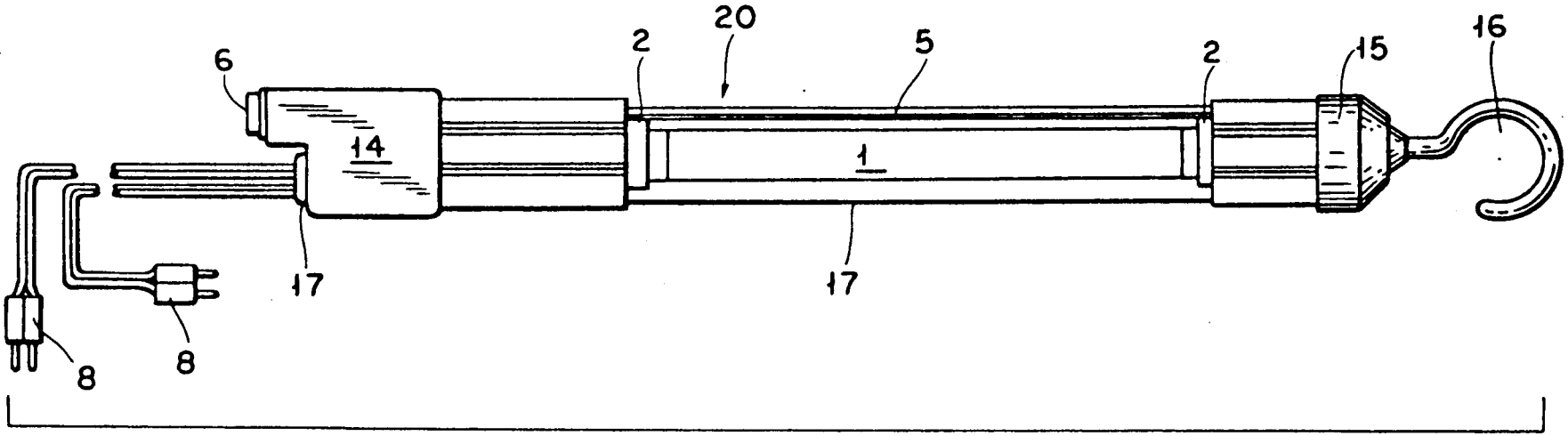
FIG. 1 is a schematic view showing the assembly of a most preferable embodiment of the present invention.
Figure 2:
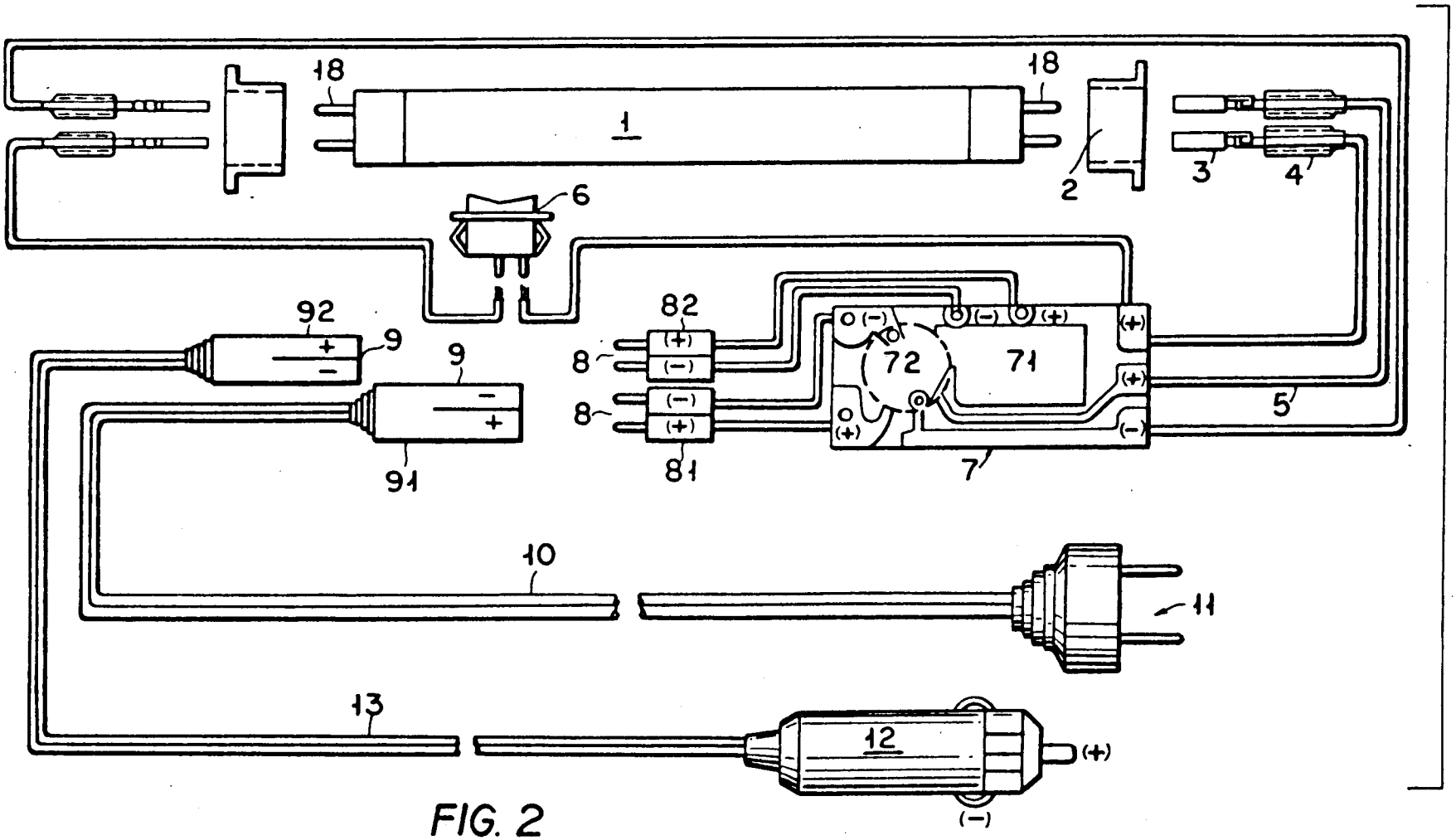
FIG. 2 shows the detailed structure of the present invention.
Figure 3:
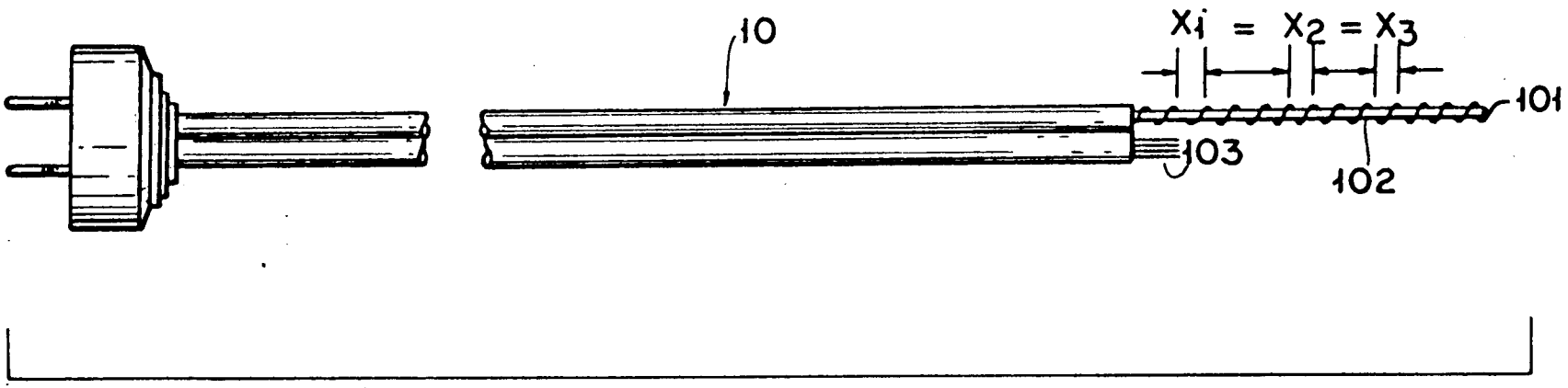
FIG. 3 shows the detailed structure of the voltage reduction wire of the present invention.

120 volts: 375 ohms (a current resisting coil of about 30 henries being further used)

220 volts: 1 kilo-ohms

That is, when different alternating current of 120 or 220 volts is used, it is not necessary to change the lamp and other related components except that only a voltage reduction wire of appropriate impedance has to be replaced (the line itself being designed to be replaceable) for use with different AC sources, rendering it extremely easy to operate and simple in structure. In addition, said voltage reduction wire is used for reducing voltage and does not produce heat such that when used for prolonged period of time, the surface temperature will not rise beyond 37 degrees C.

I claim:

1. A fluorescent light device suitable for use with power sources of 120 and 220 volts AC, comprising:

a fluorescent lamp (1);

a pair of antivibration covers (2) connected to both sides of said fluorescent lamp;

a starter switch (6) with one end electrically connected to said fluorescent lamp and the other end electrically connected to the positive end of an electronic circuit board assembly (7) for starting the fluorescent lamp;

said electronic circuit board assembly (7) comprising a current resisting coil (72) of substantially 30 henries for voltage storage and for igniting said fluorescent lamp with said starter switch;

a positive and negative bypassing connection (81) with one end connected to the current resisting coil (72) of said electronic circuit board assembly (7) and the other end connected to a first bypassing line connection seat (91);

a voltage reduction wire (10) comprising an alloy resistor wire (101) connected to the positive pole of said positive and negative bypassing line connection seat (91), a copper wire (103) connected to the negative pole of said positive and negative by passing line connection seat (91), and a fiberglass wire (102), said alloy resistor wire (101) being wound over said fiberglass wire (102), the pitches between adjacent alloy wires being equal so as to reduce the voltage of the power source;

a transparent, heat-resistant plastic tube (17) covering around said fluorescent lamp (1); and lower and upper heat-resistant grip-shaped casings (14) and (15) joined to the ends of said heat-resistant tube (17), respectively.

2. The fluorescent light device as set forth in claim 1, wherein said voltage reduction wire has an impedance of about 375 ohms when operating on 120 volts.

3. The fluorescent light device as set forth in claim 1, wherein said voltage reduction wire has an impedance of about 1 kilo-ohms when operating on 220 volts.

4. The fluorescent light device as set forth in claim 1, wherein said upper heat-resistant grip-shaped casing (15) further comprises a hook (16) for suspending said fluorescent light device.

5. A fluorescent light device suitable for use with power-sources of 120 and 220 volts AC, and 12 volt DC, comprising:

a fluorescent lamp (1);

a pair of antivibration covers (2) connected to both sides of said fluorescent lamp;

a started switch (6) with one end electrically connected to said fluorescent lamp and the other end electrically connected to the positive end of an electronic circuit board assembly (7) for starting the fluorescent lamp;

said electronic circuit board assembly (7) comprising a current resisting coil (72) of substantially 30 henries for voltage storage and for igniting said fluorescent lamp with said starter switch, and a 12 volt electronic circuit (71) for preventing high voltage return current;

a first positive and negative bypassing connection (81) with one end connected to the current resisting coil (72) of said electronic circuit board assembly (7) and the other end connected to a first bypassing line connection seat (91);

a second positive and negative bypassing connection (82) with one end connected to the 12 volt electronic circuit (71) of said electronic circuit board assembly (7) and the other end connected to a connecting to a 12 volt DC source;

a voltage reduction wire (10) comprising an alloy resistor wire (101) connected to the positive pole of said positive and negative bypassing line connection seat (91), a copper wire (103) connected to the negative pole of said positive and negative bypassing line connection seat (91), and a fiberglass wire (102), said alloy resistor wire (101) being wound over said fiberglass wire (102), the pitches between adjacent alloy wires being equal so as to reduce the voltage of the power source;

a transparent, heat-resistant plastic tube (17) covering around said fluorescent lamp (1); and lower and upper heat-resistant grip-shaped casings (14) and (15) joined to the ends of said heat-resistant tube (17) respectively.

* * * * *